United States Patent [19]

Goldstein et al.

[11] Patent Number: 4,991,145

[45] Date of Patent: Feb. 5, 1991

[54] INFRA-SONIC DETECTOR AND ALARM WITH SELF ADJUSTING REFERENCE

[75] Inventors: Steven G. Goldstein, Los Angeles; James E. Randall, Villa Park; Joseph A. Dattilo, Manhattan Beach; Gary E. Vanyek, Huntington Beach, all of Calif.

[73] Assignee: Rabbit Systems, Inc., Santa Monica, Calif.

[21] Appl. No.: 361,027

[22] Filed: Jun. 2, 1989

Related U.S. Application Data

[63] Continuation-in-part of Ser. No. 288,530, Aug. 30, 1988, Pat. No. 4,890,265.

[51] Int. Cl.[5] ..... G08B 13/22

[52] U.S. Cl. ..... 367/94; 200/61.62; 307/116; 307/141; 340/566

[58] Field of Search ..... 367/93, 94; 340/566, 340/614, 522, 523, 524, 565; 307/141, 116, 118; 200/61.62

[56] References Cited

U.S. PATENT DOCUMENTS

| | | | |
|---|---|---|---|
| 4,468,763 | 8/1984 | Braunling et al. | 340/566 X |
| 4,586,031 | 4/1986 | Grinneiser | 340/614 X |
| 4,800,298 | 1/1989 | Miller | 340/566 X |
| 4,890,265 | 12/1989 | Goldstein | 367/94 |

FOREIGN PATENT DOCUMENTS

| | | |
|---|---|---|
| 3300906 | 7/1984 | Denmark . |
| 3534277 | 4/1987 | Denmark . |
| 0159218 | 10/1985 | European Pat. Off. . |
| 2523339 | 9/1983 | France . |
| 2576438 | 7/1986 | France . |
| 2589609 | 5/1987 | France . |
| 2607296 | 5/1988 | France . |

*Primary Examiner*—Reinhard J. Eisenzopf
*Assistant Examiner*—Robert W. Mueller
*Attorney, Agent, or Firm*—Irell & Manella

[57] ABSTRACT

A detector and alarm is provided for monitoring air pressure variations in a monitored space, which variations correspond to an intrusion. An infra-sonic detector includes a microphone or the like and a low pass filter to retain only low frequency infra-sonic signals or a bandpass filter to retain a particular range of frequencies between approximately 5 Hz and 12 Hz. The instantaneous infra-sonic signals are compared against a variable reference signal, which is a voltage lagging or delayed variant of the instantaneous signals. In this manner the detector is self adjusting for slow variations in the instantaneous signals but responds immediately to rapid variations to trigger an alarm. In one embodiment the detector only senses negative going air pressure changes to trigger an alarm in order to minimize the incidence of false alarms.

8 Claims, 2 Drawing Sheets

INFRA-SONIC DETECTOR AND ALARM WITH SELF ADJUSTING REFERENCE

CROSS REFERENCES TO RELATED APPLICATIONS

This application is a continuation-in part of application Ser. No. 228,530, filed Aug. 3, 1988, now U.S. Pat. No. 4,890,265.

BACKGROUND OF THE INVENTION

This invention relates to an infra-sonic alarm system for monitoring an enclosed area, such as the interior of an automobile, and providing an alarm signal when the integrity of the enclosed area is violated by an intruder.

The prior art is replete with detectors and alarms for monitoring enclosed areas including automobiles. Such detectors and alarms operate on various principles, including infrared and ultrasonics. These devices each have their advantages and disadvantages, which are well known to those working in the field of alarm or monitoring systems.

There exists U.S. Pat. No. 4,586,031 directed towards what is described as an infra-sonic detector and alarms using such a detector. The infra-sonic detector disclosed in this patent is disclosed as a microphone or other suitable detector for detecting air pressure variations, which is associated with filtering means for extracting the low frequency sounds of interest, which are below 20 Hz. The circuit and alarm arrangement of that patent includes a threshold circuit for comparing the signal from the low pass filter arrangement to a fixed reference to generate a trigger signal for activating an alarm. A manual sensitivity control is provided for adjusting the level of the fixed reference.

In the arrangement disclosed in U.S. Pat. No. 4,586,031, there is a description of various bands of frequencies, ranging from below 0.3 Hz to above 4.5 Hz. The patent contemplates providing sensing in these various bands of frequencies in order to avoid false alarms and the like. The patent states that: "The use of the B [0.3–0.7 Hz] and C [0.7–1.8 Hz] bands obviates any difficulties from very slow pressure variations (temperature rise of a vehicle situated in full sunlight, change from daytime to nighttime conditions, and so on) and fast variations (e.g. infra-sonics of the frequencies of bands D [1.8–4.5 Hz] and E [above 4.5 Hz] produced by a vehicle passing nearby)."

OBJECTS AND SUMMARY OF THE INVENTION

It is an object of this invention to provide an improved infra-sonic detector and alarm which minimizes false alarms.

It is a more specific objective of this invention to provide an infra-sonic detector and alarm which compares an instantaneous detector signal against a variable time-lagging reference signal for inhibiting slow-varying air pressure changes in a monitored area from causing a false alarm, and which is therefore self-adjusting.

It is a still further object of this invention to provide an infra-sonic detector which is less likely to produce a false alarm.

Briefly, in accordance with one embodiment of the invention, a sensor such as a microphone which is sensitive to air pressure variations is disposed within an enclosed area which is to be monitored, such as the interior of an automobile. The sensor's output is amplified and filtered through a low-pass filter which passes only infra-sonic signals. The filtered infra-sonic signal is split into two signal paths, which are applied to two inputs of a comparator. One of the signal paths serves as a variable reference and includes a time delay. In this manner, the detector is self adjusting so that only rapidly changing infra-sonic signals cause an alarm output from the comparator. By using such a variable reference technique, enhanced detector sensitivity is achieved while avoiding false alarms. In accordance with another embodiment, the infra-sonic detector is bandpass filtered, and only negative infra-sonic pressure changes are utilized to activate an alarm, providing enhanced protection against false alarms.

DETAILED DESCRIPTION

Figure 1:
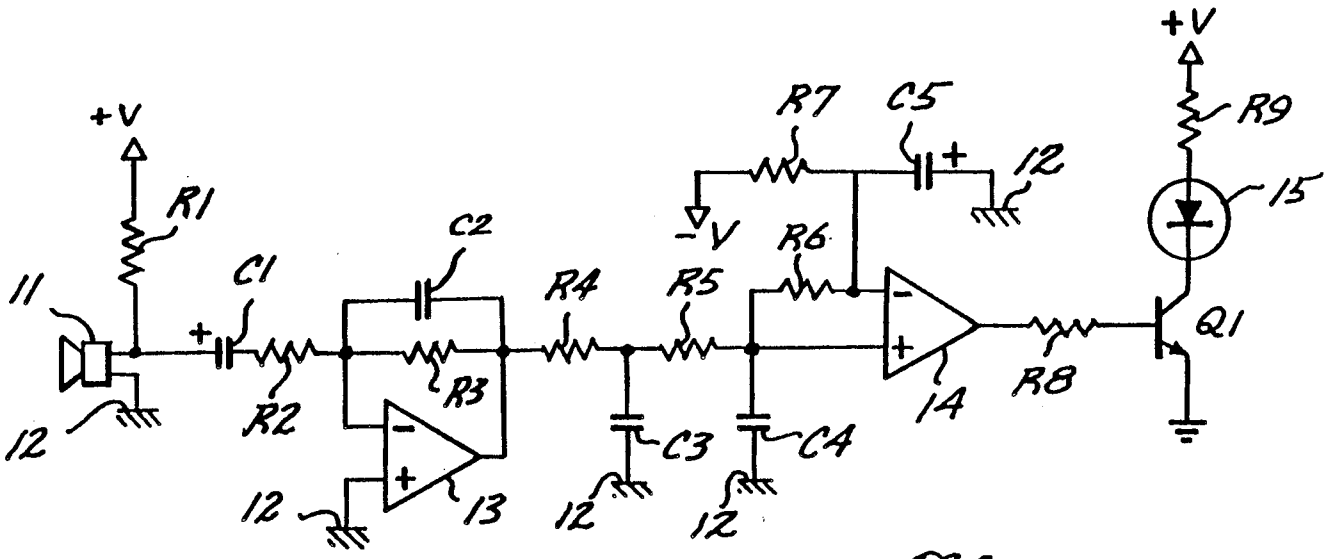
FIG. 1 shows a circuit diagram for one embodiment of an infra-sonic detector and alarm in accordance with a preferred embodiment of the invention.

Turning now to a discussion of the drawings, FIG. 1 illustrates the basic circuit of an infra-sonic detector and alarm in accordance with a preferred embodiment of the invention. An electret microphone 11 is biased through a resistor R1 to a source of voltage +V against an artificial ground 12 (discussed below in connection with FIG. 2). The output of the electret microphone 11 is A.C. coupled through a capacitor C1 and a resistor R2 to an inverting input of an amplifier 13. The non-inverting input of amplifier 13 is biased to the artificial ground 12 (power supply center). A capacitor C2 and resistor R3 are connected between the inverting input of amplifier 13 and its output, with capacitor C2 providing low pass filtering and stabilizing the amplifier 13 against possible oscillations. The value of the capacitor C2 can be selected to, for example, pass signals below 3 KHz. In accordance with a preferred embodiment of the invention, the amplifier 13 is selected to have a gain of approximately 47.

In FIG. 1 the network formed by resistor R4, capacitor C3, resistor R5, and capacitor C4 forms a two pole low-pass filter. In accordance with a preferred embodiment of the invention this network has a 1.5 Hz cut-off, which functions to extract the infra-sonic component from the amplified signal.

The infra-sonic signal output of the two pole low-pass filter network is presented to both inputs of a comparator 14. The non-inverting input to the comparator 14 receives the instantaneous infra-sonic output of the filter network. The inverting input to the comparator 14 is used as a variable reference against which the instantaneous infra-sonic signal is compared. The resistors R6 and R7 cause the signal at the inverting input to the comparator 14 to be somewhat higher than the input at the non-inverting input, approximately 16% higher in accordance with one embodiment. Therefore, in a quiescent state, the inverting input is higher, resulting in a first state for the output of comparator 14. A capacitor C5 is coupled to the inverting input to comparator 14 and functions to cause the inverting input to be voltage lagging, i.e. time delayed inasmuch as rapid increases in the signal at the inverting input charge up capacitor C5.

For very slow voltage variations of the infra-sonic signal output of the low pass filter, the relationship between the two inputs of the comparator 14 (non-inverting somewhat lower than inverting) remains the same, and the comparator's output does not switch. But for rapid positive going excursions of the infra-sonic signal from the low pass filter, the inverting input lags significantly behind the non-inverting input because of the capacitor C5, enabling the non-inverting input to become more positive than the inverting input with a resulting change of state at the comparator's output to generate a trigger signal.

The change of state output of comparator 14 constitutes a trigger signal that can be utilized to activate an alarm of whatever type is desired. As an example, in FIG. 1 the comparator output is shown as coupled through a resistor R8 to drive a transistor Q1 having an alarm circuit such as a light emitting diode 15 and resistor R9. Of course, audible alarm indicators such as a siren or horn or the like can be provided instead of or in addition to a visual indicator.

Figure 2:
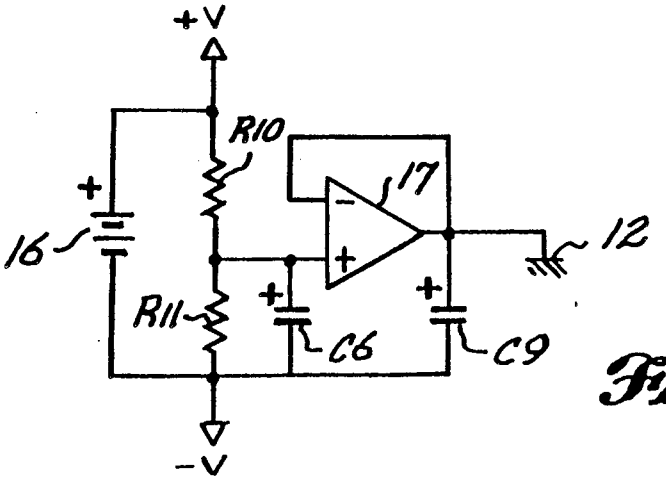
FIG. 2 shows a circuit diagram for a power supply for the circuit of FIG. 1.

FIG. 2 shows the circuit diagram of the power supply for the circuit of FIG. 1. In FIG. 2, a battery 16 which may, for example, be a 6 volt battery, is connected across a network formed by resistors R10 and R11 to provide voltages +V and −V as shown. The midpoint between resistors R10 and R11 is an input to an operational amplifier 17, stabilized by capacitors C6 and C7. The output of the operational amplifier is the artificial ground 12. This power supply circuit splits the power supply into reference voltages +V and −V for insuring stable and accurate operation of the detector and alarm circuit of FIG. 1.

In accordance with a particular embodiment of the circuits of FIG. 1 and FIG. 2, the values of the circuit elements illustrated are as follows:

| | |
|---|---|
| R1 - 1K ohms | C1 - 4.7 mf. |
| R2 - 47K ohms | C2 - 22 pf. |
| R3 - 2.2 M ohms | C3 - 2.2 mf. |
| R4 - 47K ohms | C4 - .33 mf. |
| R5 - 300K ohms | C5 - 1 mf. |
| R6 - 1 M ohms | C6 - 10 mf. |
| R7 - 10 M ohms | C7 - 10 mf. |
| R8 - 10K ohms | |
| R9 - 1K ohms | |
| R10 - 100K ohms | |
| R11 - 100K ohms | |

Figure 3:
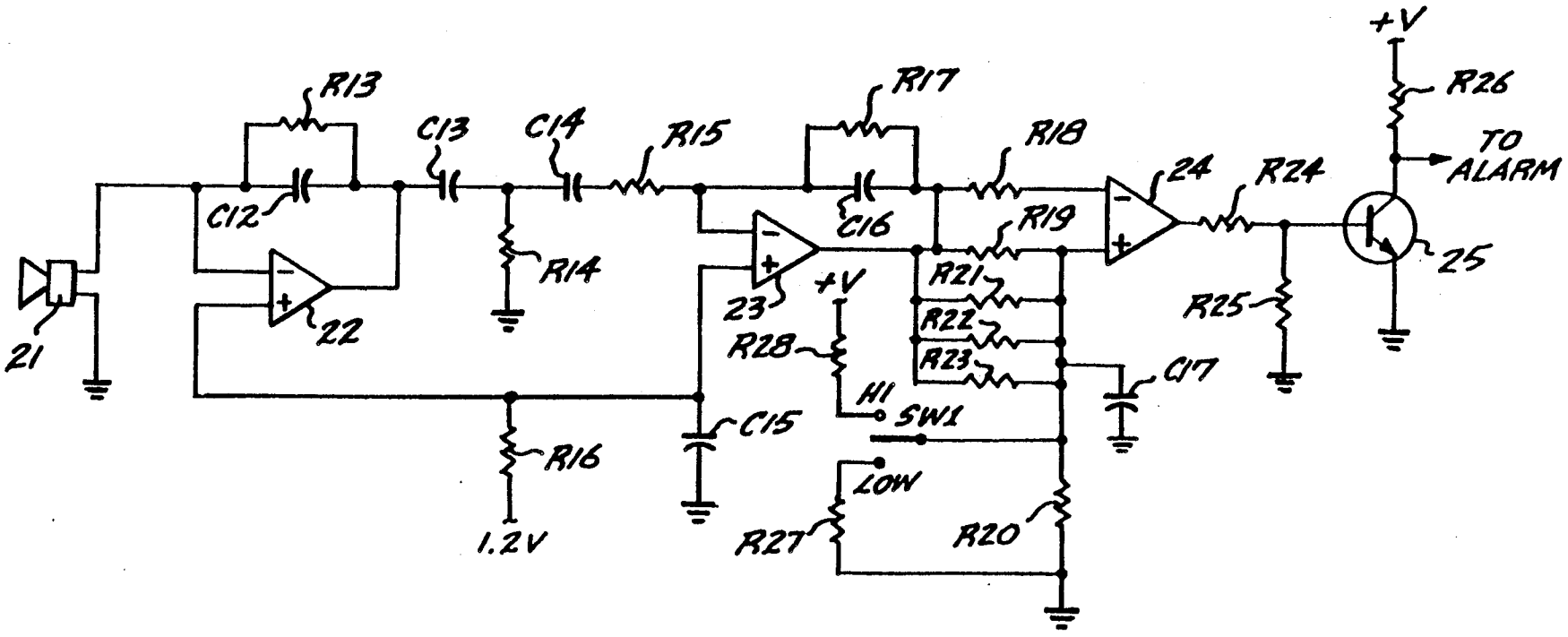
FIG. 3 shows a circuit diagram of an alternate embodiment of an infra-sonic detector and alarm using bandpass filtering, and which only generates an alarm in response to negative going infra-sonic pressure changes.

Turning now to FIG. 3, there is shown a circuit diagram of an alternate embodiment of an infra-sonic detector and alarm in accordance with the invention, which has enhanced protection against generating false alarms. Specifically, extensive testing of a detector and alarm in accordance with the invention in an actual in-automobile environment has led to two discoveries which are very effective in reducing the incidence of false alarms. First, it has been unexpectedly discovered that the inclusion of infra-sonic signals below about 4 Hz increases the incidence of false alarms. This is unexpectedly so, and is contrary to the teachings of the prior art, i.e. The U.S. Pat. No. 4,586,031. Second, it has been discovered through extensive actual testing that substantial improvement in minimizing false alarms can be achieved through rejecting infra-sonic signals related to positive going infra-sonic pressure changes, and only utilizing negative going infra-sonic pressure changes to generate an alarm. The reason for this is that events which tend to cause false alarms such as a truck or bus drive-by and wind gusts, tend to result in positive pressure changes within the interior of an automobile or other protected space. Entry events such as door, window or trunk openings of the automobile or other protected space tend to result in negative pressure changes. The circuit of FIG. 3 is an embodiment of the invention which implements these findings to provide a detector and alarm with enhanced protection against generation of false alarms.

In FIG. 3, circuit elements such as power supplies, etc. have been eliminated, and the circuit is shown only in sufficient detail for an understanding of the invention and its principles. Suitable power supplies, bias circuitry, etc. are easily provided by anyone skilled in electronics. In the circuit of FIG. 3, an electret microphone 21 detects infra-sonic variations in air pressure in a protected space, such as the interior of an automobile, and passes a current signal to a low pass filter comprised of capacitor C12 and resistor R13. In accordance with a particular embodiment of the invention, the values of C12 and R13 are selected such that the 3 dB cut-off point of the filter is 10.6 Hz. The microphone is biased to a 1.2 volt level, and works into a virtual ground at the minus input of an operational amplifier 22. Thus, the microphone is supplying all the current it can from the infra-sonic signal into the virtual ground at the minus input of the operational amplifier. The output of operational amplifier 22 is a voltage output proportional to the current input from the microphone.

Capacitors C13 and C14, together with resistors R14 and R15, comprise a two pole or two section high pass filter. The first section comprised of capacitor C13 and resistor R14 has in accordance with a particular embodiment of the invention a cut off of 4.8 Hz, and the second section comprised of capacitor C14 and resistor R15 has a cut off of 7.2 Hz.

As shown in FIG. 3, a 1.2 volt reference is connected through a resistor R16 to the plus inputs of operational amplifiers 22 and 23. The value of R16 is selected to give approximately zero offset to the input bias current supplied to operational amplifiers 22 and 23, so that the output of operational amplifier 23 more precisely reflects the reference voltage. Capacitor C15 is provided to reduce noise at low frequencies that might be present in the reference voltage, due to battery ripple, etc.

The output of R15 is again a current signal, which is supplied to a virtual ground at the minus input of an operational amplifier 23. Resistor R17 and capacitor C16 provide a current to voltage conversion and gain, and functions as a low pass filter having, in accordance with a particular embodiment, a cut off of 12.9 Hz.

The combination of the low pass and high pass filter arrangements thus far discussed works in combination to provide a band pass characteristic, having a bandpass of approximately 5 Hz to approximately 12 Hz. This range of infra-sonic signals has been found experimentally to minimize the incidence of false alarms while providing an assured alarm in the event of an intrusion.

The output of operational amplifier 23 is at an accurate 1.2 volt d.c. level, which is connected through a resistor R18 directly to the minus input of a comparator 24. The same voltage is applied to the plus input of comparator 24, but through a resistor network comprising resistors R19, R21, R22 and R23. Current is drawn through this resistor network and through resistor R20 to ground, which causes the plus input to comparator 24 to be at a quiescent d.c. voltage level below that of the minus input. Thus, in a quiescent state, the voltage at the plus input to comparator 24 will be at a lower level than the voltage at the minus input, causing the output of the comparator to be at a low level.

The four resistors R19, R21, R22 and R23 are used in a production setting to calibrate each individual detector circuit. For example, a known sound pressure level is applied to the microphone 21 in the pass band of the system and the resultant output of operational amplifier 23 is measured. Due to variability in the output of the microphone and variability in the gain of the amplifiers due to production tolerances, variations in the output of operational amplifier 23 may result. Using actual measurements with a known sound pressure level, this variability is accounted for by "clipping" or removing various of the resistors R19, R21, R22 and R23 to provide a standard calibrated sensitivity or input to comparator 24.

For dealing with an a.c. infra-sonic signal at the plus input to comparator 24, a bypass capacitor C17 is provided. For a rapid pulse type infra-sonic signal characteristic of an intrusion, the plus input to comparator 24 will not change rapidly because of this bypass capacitor C17, but the minus input to the comparator 24 will follow the rapid pulse signal. Because of this, and because the plus input is biased slightly negative, if there were a positive transition or positive pulse at the output of operational amplifier 23, the minus input to comparator 24 would simply be raised higher than the plus input, which was already the case in the quiescent state, so that the output of comparator 24 would remain low. Thus, the comparator is insensitive to positive going infra-sonic signals, i.e. signals corresponding to positive going air pressure changes. However, for a negative going transition or infra-sonic signal corresponding to a negative going air pressure change, and depending on its magnitude compared to the offset between quiescent voltage on the plus and minus inputs to comparator 24, the minus input can or will be driven below the plus input, resulting in the output of the comparator going high. The output of the comparator is coupled through a resistor network R24, R25 to a transistor 25 which is appropriately biased through a resistor R26. Turn on of transistor 25 is used as an alarm indication to drive any kind of desired alarm, such as an alarm light, siren, etc.

The capacitor C17 also functions to provide a variable reference to the comparator 24. In the prior art, fixed offset or reference voltages have been used against which an instantaneous infra-sonic signal was compared. The problem is that slowly varying infra-sonic signals, e.g. due to slow variations in air pressure, would change the offset used for comparison and affect the sensitivity of the device or even cause false alarms. By use of the variable reference established by capacitor C17, the relationship between the two inputs to the comparator 24 does not change due to slowly varying infra-sonic signals, but only for rapidly changing pulse type signals desired to be detected as evidencing an intrusion into the protected or monitored space.

The particular embodiment of the invention shown in FIG. 3 also includes a sensitivity switch for varying the sensitivity of the detector circuit to infra-sonic signals. Thus this sensitivity switch SW1 has three positions, low, intermediate and high, as shown in FIG. 3. If the switch SW1 is moved to the low sensitivity position, a resistor R27 is put in parallel with resistor R20, and more d.c. current is drawn through the bias network connected to the plus terminal of comparator 24. This means that the voltage at the plus input of comparator 24 is more negative (or less positive) than before, which means that a greater magnitude negative going infra-sonic signal is required to overcome the bias or offset between the plus and minus inputs of comparator 24 to cause its output to go high and signal an alarm condition. In accordance with a particular embodiment of the invention, an approximate 6 dB change in sensitivity occurs when the switch SW1 is moved to the low sensitivity position. Correspondingly, when the switch SW1 is moved to the high sensitivity position, a supply +V is connected through a resistor R28 adding bias current through resistor R20. This causes the voltage across R20 to be higher than before, which means less of an offset between the plus and minus inputs to comparator 24. This gives an increased sensitivity of the detector circuit, again on the order of 5-6 dB.

In accordance with a particular embodiment of the invention as illustrated in FIG. 3, the values of the circuit elements illustrated are as follows:

| | |
|---|---|
| R13 - 680 ohms | |
| R14 - 1.5K ohms | C12 - 22 uf |
| R15 - 10K ohms | C13 - 22 uf |
| R16 - 220K ohms | C14 - 2.2 uf |
| R17 - 560K ohms | C15 - 1O uf |
| R18 - 100K ohms | C16 - 0.047 uf |
| R19 - 150K ohms | C17 - 10 uf |
| R20 - 1 M ohms | |
| R21 - 75K ohms | |
| R22 - 620K ohms | |
| R23 - 300K ohms | |
| R24 - 100K ohms | |
| R25 - 100K ohms | |
| R26 - 220K ohms | |
| R27 - 820K ohms | |
| R28 - 3.6 M ohms | |

While the invention has been illustrated and described with respect to particular embodiments, it should be clearly understood that it is not thereby intended to limit the invention to that particular embodiment, and that variations may be made by those skilled in this art without departing from the true spirit and scope of this invention.

We claim:

1. An infra-sonic detector and alarm system for detecting intrusion in a monitored air space comprising:

a transducer for sensing air pressure variations in the monitored space and producing an electrical air pressure variation signal;

amplifier means for amplifying electrical air pressure variation signal;

bandpass filter means for passing only infra-sonic portions of the electrical air pressure variation signal between approximately 5 Hz and 12 Hz;

a self-adjustable reference circuit for providing a self-adjustable reference signal in response to slow air pressure variations due to atmospheric phenomena, comparator means for comparing the instantaneous infra-sonic signal portions of the electrical air pressure variation signal to said self-adjustable reference signal for generating a trigger signal when said instantaneous infra-sonic portions exceed the self-adjustable reference signal; and alarm means activated by said trigger signal.

2. An infra-sonic detector in accordance with claim 1, wherein said comparator means is biased in such a way that it is only responsive to the instantaneous and bandpass filtered infra-sonic signal corresponding to a negative going air pressure variation in the monitored space to generate said trigger signal.

3. An infra-sonic detector in accordance with claim 2, wherein said comparator means has a monitoring input and a self-adjustable reference input, with said instantaneous infra-sonic signal portions being applied to both said monitoring input and said self-adjustable reference input through impedance means such that the self-adjustable reference input is normally lower than the monitoring input to produce a first comparator output state, and including voltage delay means coupled to the self-adjustable reference input, whereby only rapid negative going changes in the instantaneous infra-sonic signal portions cause the monitoring input to the comparator means to cross the self-adjustable reference input to thereby cause a change of state of the comparator output to a second state corresponding to a trigger signal.

4. An infra-sonic detector in accordance with claim 3 wherein said voltage delay means comprises a capacitor.

5. An infra-sonic detector and alarm system for detecting intrusion in a monitored air space comprising:

a transducer for sensing air pressure variations in the monitored space and producing an electrical pressure variation signal;

amplifier means for amplifying the electrical pressure variation signal;

bandpass filter means for passing only infra-sonic portions of the electrical pressure variation signal;

comparator means biased in such a way that it is only responsive to the instantaneous and bandpass filtered infra-sonic signal portions of the electrical pressure variation signal corresponding to a negative going air pressure variation in the monitored space when said instantaneous infra-sonic portions cross a self-adjustable reference signal; and alarm means activated by a trigger signal.

6. An infra-sonic detector in accordance with claim 5 further including a self-adjustable reference circuit for providing said self-adjustable reference signal in response to slow air pressure variations due to atmospheric phenomena.

7. A infra-sonic detector in accordance with claim 5 wherein said comparator means has a monitoring signal input and a self-adjustable reference signal input with a quiescent DC signal offset between them, with said instantaneous infra-sonic signal portions being applied to both said monitoring signal input and said self-adjustable reference signal input and said self-adjustable reference signal input is normally lower than the monitoring signal input to produce a first comparator output state, and including voltage delay means coupled to said self-adjustable reference signal input, whereby only rapid negative going changes in the instantaneous infra-sonic signal portions cause the monitoring signal input of the comparator to cross the self-adjustable reference signal input thereby cause a change of state of the comparator output to a second state corresponding to said trigger signal.

8. An infra-sonic detector in accordance with claim 7 including sensitivity control means for changing the sensitivity of the detector by varying the quiescent d.c. signal offset between the monitoring input and variable reference input of said comparator means.

* * * * *